US006802598B2

(12) United States Patent
Ito et al.

(10) Patent No.: US 6,802,598 B2
(45) Date of Patent: Oct. 12, 2004

(54) INK JET HEAD AND PRODUCTION METHOD OF THE SAME

(75) Inventors: Takeshi Ito, Hino (JP); Hideo Watanabe, Hino (JP); Hiroyuki Nomori, Hino (JP)

(73) Assignee: Konica Corporation (JP)

( * ) Notice: Subject to any disclaimer, the term of this patent is extended or adjusted under 35 U.S.C. 154(b) by 54 days.

(21) Appl. No.: 10/264,976

(22) Filed: Oct. 4, 2002

(65) Prior Publication Data

US 2003/0035031 A1 Feb. 20, 2003

Related U.S. Application Data

(62) Division of application No. 09/616,754, filed on Jul. 14, 2000, now abandoned.

(30) Foreign Application Priority Data

Jul. 23, 1999 (JP) ..... 11-210003

(51) Int. Cl.[7] ..... B41J 2/045

(52) U.S. Cl. ..... 347/71

(58) Field of Search ..... 347/71, 72, 68; 24/25.35; 427/457, 565; 428/480

(56) References Cited

U.S. PATENT DOCUMENTS 5,939,206 A * 8/1999 Kneezel et al. ..... 428/480

FOREIGN PATENT DOCUMENTS

JP 2002029061 A * 1/2002 ..... B41J/02/16

* cited by examiner

*Primary Examiner*—K. Feggins
(74) *Attorney, Agent, or Firm*—Muserlian, Lucas and Mercanti

(57) ABSTRACT

An ink-jet head, comprises an ink chamber in which ink is stored; a piezoelectric element to jet the ink from the ink chamber; an electrode to apply an electric voltage onto the piezoelectric element; and a layer provided on the electrode by an electrodeposition method. The layer is subjected to a process to change a surface energy.

10 Claims, 2 Drawing Sheets

INK JET HEAD AND PRODUCTION METHOD OF THE SAME

CROSS-REFERENCE TO RELATED APPLICATIONS.

This Application is a divisional of U.S. application Ser. No. 09/616,754 now abandon, filed Jul. 14, 2000.

BACKGROUND OF THE INVENTION

The present invention relates to an ink jet head and a production method of the same.

In an ink jet head employed in ink jet printers, a method is available in which a pressure pulse is generated in the ink chamber employing a piezoelectric element, and thus ink droplets are ejected from the nozzle. In said piezoelectric element, an electrode, which applies driving voltage, is essential, and said electrode is arranged, being in direct contact with ink. When the electrode is brought into contact with a water based ink, water in the ink is subjected to electrolysis which generates bubbles, while the electrode is dissolved resulting in disconnection while running. Further, even when oil based ink is employed, carbon chains are formed from organic materials in the ink to cause short circuit. Accordingly, it is desired to protect the electrode from ink. In order to achieve this goal, it is known that various types of organic or inorganic layers are formed on the electrode.

Listed as such inorganic layers are various types of oxides and nitrides. For instance, included are silicon-oxygen (SiO), silicon-nitrogen (SiN), silicon-oxygen-nitrogen (SiON), silicon-carbon (SiC), aluminum-nitrogen (AlN), silicon-aluminum-nitrogen (SiAlN), aluminum-oxygen (AlO), aluminum-silicon-oxygen (AlSiO), and silicon-aluminum (SiAl).

Employed as organic layers are various types of polymer layers, and it is proposed to employ polyparaxylene as representative polymers.

When bubbles are mixed in an ink channel, especially in an ink chamber to which pressure is applied employing a piezoelectric element, said bubbles absorb applied pressure which decreases the speed of ejected ink or occasionally results in no ink ejection. Accordingly, in the ink jet head, it is required that the interior of the ink channel be smooth and continuous.

SUMMARY OF THE INVENTION

From the foregoing, the present invention has been achieved. It is a first object of the present invention to provide an ink jet head in which degradation of the electrode of said ink jet head is minimized. It is a second object of the present invention to provide an ink jet head comprising a layer on the electrode which is readily formed. It is a third object of the present invention to provide an ink jet head in which each member in said ink jet head is not degraded and a smooth and continuous layer, which covers the electrode, can be easily formed.

In order to solve the aforementioned problems, as well as to achieve the objects, the present invention has been embodied as described below.

(1-1) An ink-jet head, comprises:

an ink chamber in which ink is stored;

a piezoelectric element to jet the ink from the ink chamber;

an electrode to apply an electric voltage onto the piezoelectric element;

a layer provided on the electrode by an electrodeposition method, the layer subjected to a process to change a surface energy.

According to (1-1), since materials, which are deposited employing electrodeposition, generally have a functional group, it is possible to control properties of a layer by controlling the amount of said functional group or by selecting the materials used. Thus it is possible to form a desired layer with response to the characteristics of an ink jet head as well as the ink itself. Further, when a treatment is carried out to vary surface energy, it is possible to markedly enhance the wettability between the ink jet head and the ink.

Further, when a layer is formed employing an electrodeposition method (even when a protective layer is formed employing materials which are inherently hydrophilic), the surface energy increases while minimizing the solubility of said surface layer in the ink. However, this causes a problem with insufficient wettability of the ink. In order to overcome this problem, when a treatment to vary the surface energy is carried out, it is possible to increase the wettability for the ink.

(1-2) In the ink-jet head of (1-1), the process to change a surface energy is a process to increase the surface energy.

(1-3) In the ink-jet head of (1-1), the process to change a surface energy is an oxidizing process.

(1-4) In the ink-jet head of (1-3), the oxidizing process is a plasma process.

(1-5) In the ink-jet head of (1-1), the layer contains polyimide.

(1-6) In the ink-jet head of (1-1), a thickness of the layer is 0.1 $\mu$m to 50 $\mu$m.

(1-7) An ink-jet head, comprises:

an ink chamber in which ink is stored;

a piezoelectric element to jet the ink from the ink chamber;

an electrode to apply an electric voltage onto the piezoelectric element;

a layer provided on the electrode by an electrodeposition method, the layer containing polyimide.

According to (1-7), when a polyimide layer is formed by electrodepositing a polyimide precursor followed by heating the deposited layer at relatively,high temperature, there is the possibility that the piezoelectric element, having a lower heat resistance, is damaged. However, it is possible to overcome this problem as follows. When the polyimide itself is electrodeposited, it becomes unnecessary to heat the piezoelectric element to a relatively high temperature. Thus it is possible to employ a piezoelectric element having a lower heat resistance. Further, when heated to a relatively high temperature, the polyimide melts to a fluid and the polyimide layer is partially removed to form pinholes. As a result, insulation degradation tends to occur. However, when the polyimide is electrodeposited, no heating is required to a relatively high temperature. As a result, it is possible to minimize such problems.

(1-8) In the ink-jet head of (1-7), the polyimide is made from 3,5-diaminobenzoic acid.

(1-9) In the ink-jet head of (1-7), a thickness of the layer is 0.1 $\mu$m to 50 $\mu$m.

(1-10) An ink-jet head, comprises:

an ink chamber in which ink is stored;

a piezoelectric element to jet the ink from the ink chamber;

an electrode to apply an electric voltage onto the piezoelectric element;

a first layer provided on the electrode by an electrodeposition method, and a second layer provided on the electrode.

(1-11) In the ink-jet head of (1-10), the second layer is an organic layer.

(1-12) In the ink-jet head of (1-11), the organic layer contains polyparaxylylene.

(1-13) In the ink-jet head of (1-10), the first layer contains polyimide.

(1-14) In the ink-jet head of (1-10), a thickness of the layer is 0.1 $\mu$m to 50 $\mu$m.

(1-15) In the ink-jet head of (1-10), a thickness of a composite layer of the first layer and the second layer is 0.1 $\mu$m to 50 $\mu$m (1-16) An ink-jet head, comprises:

an ink chamber in which ink is stored;

a piezoelectric element to jet the ink from the ink chamber;

an electrode to apply an electric voltage onto the piezoelectric element;

a first layer containing polyimide provided on the electrode, and a second layer being an organic layer provided on the electrode.

(1-17) In the ink-jet head of (1-16), a thickness of a composite layer of the first layer and the second layer is 0.1 $\mu$m to 50 $\mu$m.

(1-18) In the ink-jet head of (1-16), the organic layer contains polyparaxylylene.

According to (1-10) or (1-16), it is possible to realize an ink jet head having ink resistance as well as insulation properties.

(1-19) A method of manufacturing an ink-jet head, comprises:

a step of forming a layer by an electrodeposition method on an electrode to drive a piezoelectric element to jet an ink from an ink chamber, and a step of applying a process to change a surface energy onto the layer.

(1-20) A method of manufacturing an ink-jet head, comprises:

a step of forming a layer containing polyimide by an electrodeposition method on an electrode to drive a piezoelectric element to jet an ink from an ink chamber.

(1-21) A method of manufacturing an ink-jet head, comprises:

a step of forming a first layer by an electrodeposition method on an electrode to drive a piezoelectric element to jet an ink from an ink chamber, and a step of forming a second layer on the electrode.

(1-22) A method of manufacturing an ink-jet head, comprises:

a step of forming a first layer containing polyimide and a second layer being an organic layer on an electrode to drive a piezoelectric element to jet an ink from an ink chamber, wherein the first layer is formed by an electrodeposition method.

Further, the above object may be attained by the following preferable embodiments.

(2-1) In an ink jet head wherein a piezoelectric element is driven and pressure is applied to ink to eject said ink from a nozzle, an ink jet head comprising a polyimide layer which covers the electrode which applies voltage to said piezoelectric element.

According to the invention described in (1) above, by comprising the polyimide layer which covers the electrode which applies voltage to the piezoelectric element, it is possible to protect said electrode from the corrosive action of the ink and to minimize the degradation of each member. In addition, said polyimide layer exhibits high critical surface tension as well as high wettability to ink. Thus, it is possible to obtain stable ejection.

(2-2) The ink jet head described in (2-1), comprising said poyimide layer as well as an organic layer in a multilayer form.

According to the invention described in (2-2) above, by applying said polyimide layer as well as said organic layer in a multilayer form, it is possible to more efficiently protect an electrode from ink and to minimize the degradation of each member.

(2-3) The ink jet head described in (2-1), wherein the thickness of said polyimide layer is in the range of 0.1 to 50 $\mu$m.

According to the invention described in (2-3) above, a smooth layer is obtained; no pinholes are formed; no pressure loss occurs due to the deformation of a member, which applies pressure to ink, employing the layer thickness; and it is thereby possible to carry out excellent ink ejection.

(2-4) The ink jet head described in (2-1), wherein the thickness of said polyimide layer and said organic layer in a multilayer form is in the range of 0.1 to 50 $\mu$m.

According to the invention described in (2-4) above, a smooth layer thickness is obtained; no pinholes are formed; no pressure loss results due to the deformation of a member, which applies pressure to ink, employing the layer thickness; and it is thereby possible to carry out excellent ink ejection.

Particularly, when a layer comprised of polyimide is provided on a layer comprised of polyparaxylylene, a palylene layer, which tends to form pinholes, is formed in advance, and the upper layer is comprised of polyimide. Thus wettability is enhanced and more stable ejection is possible.

(2-5) In an production method of an ink jet head in which a piezoelectric element is activated to eject ink, a production method of an ink jet head characterized in that a polyimide layer is provided which covers an electrode which applies voltage to said piezoelectric element.

According to the invention described in (2-5) above, it is possible to protect said electrode from the corrosive action of the ink; employing a simple configuration in which a polyimide layer, which covers said electrode, is provided. Further, it is possible to obtain an ink jet head in none of members are degraded, one which exhibits high critical surface tension as well as high wettability, and which results in stable ejection.

(2-6) The production method of an ink jet head described in (2-5), wherein said polyimide layer is provided on said electrode, employing an electrodeposition method.

According to the invention described in (2-6) above, it is possible to provide a polyimide layer which covers an electrode, by operating at normal pressure a unit comprised of an electrodeposition tank having dimensions similar to an ink jet head currently under production, and a small-scaled direct current source. Further, generally, own layer thickness control properties are exhibited in which the rate of electrodeposition decreases rapidly as electrodeposited thickness increases. However, by forming a layer employing an electrodeposition method in which an exposed electrode in an ink channel is used as the electrodeposition electrode, it is possible to readily form a smooth and continuous layer which covers said electrode. Further, compared to the conventional layer formation employing an electrodeposition method, which uses polyamide acids, a process is not required in which heating is carried out at relatively high temperature, and thus none of members in said ink jet head are degraded.

(2-7) The production method of an ink jet head described in (2-5) or (2-6), wherein said poyimide layer as well as said organic layer are provided in multilayer.

According to the invention described in (2-7) above, by providing a polyimide layer as well as an organic layer in a multilayer form, it is possible to more preferentially protect electrodes from the corrosive action of the ink to minimize the degradation of all members.

DETAILED DESCRIPTION OF THE PREFERRED EMBODIMENTS

In the following, the embodiments of the ink jet head, as well as the production method of the same, of the present invention will be described with reference to the drawings. However, the present invention is not limited to these embodiments. Specifically, the present invention is in effect, even when analogous configurations, shapes and other materials are employed without depending on the drawings of these embodiments and examples.

Figure 1:
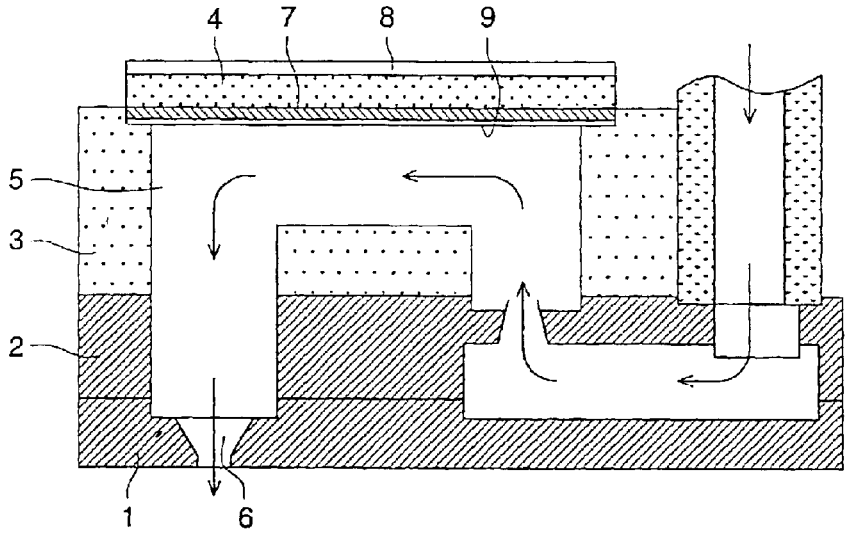
FIG. 1 is a cross-sectional view showing a schematic configuration of an ink jet head.
Figure 2:
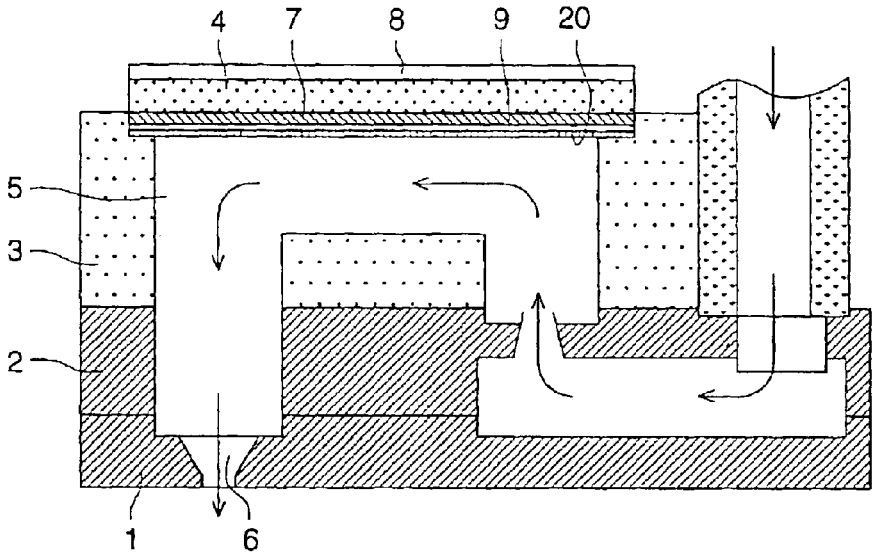
FIG. 2 is a cross-sectional view of another embodiment showing a different schematic configuration of an ink jet head.

FIG. 1 is a cross-sectional view showing a schematic configuration of an ink jet head, while FIG. 2 is a cross-sectional view of another embodiment showing a different schematic configuration of an ink jet head.

In the ink jet head of this embodiment, ink chamber 5 is formed employing plates 1, 2, and 3 and piezoelectric element 4 which is mounted on plate 3. In plate 1, nozzle 6 is formed. Electrodes 7 and 8 are provided on both sides of piezoelectric element 4. When voltage is applied to electrodes 7 and 8, piezoelectric element 4 is defoamed, whereby water based ink in ink chamber 5 is compressed and ejected from nozzle 6.

Electrode 7 provided with piezoelectric element 4, which is in direct contact with ink, comprises polyimide layer 9 which covers electrode 7. By providing polyimide layer 9, which covers electrode 7, it is possible to protect electrode 7 from the corrosive action of the ink and to minimize the degradation of each member. In addition, polyimide layer 9 exhibits high critical surface tension as well as high wettability with the ink. Thus it is possible to obtain more stable ejection operation.

It is further possible to provide polyimide layer 9 and organic layer 20 forming a multilayered structure. In this case, as shown in FIG. 2, electrode 7 is mounted on polyimide layer 9, onto which organic layer 20 may be applied. Alternatively, electrode 7 is provided on organic layer 20, onto which polyimide layer 9 may be applied. By providing polyimide layer 9 and organic layer 20 as a multilayered structure, it is possible to protect electrode 7 from the corrosive action of the ink and to minimize the degradation of each member.

Still further, the thickness of the polyimide layer is preferably in the range of 0.1 to 50 $\mu$m, and is more preferably in the range of 0.1 to 10 $\mu$m. When the thickness is not less than 0.1 $\mu$m, it is possible to form a layer having a uniform thickness without any pinholes. On the other hand, when the thickness is not larger than 50 $\mu$m, no pressure loss results due to the deformation of the member which presses ink employing the layer, and it is possible to carry out excellent ink injection.

Specifically, when polyparaxylylene is provided as a lower layer and polyimide is provided as an upper layer, (namely, when each layer is provided so that the paraxylylene layer is provided more adjacent to the electrode than the polyimide layer), Palylene, having pinholes, is formed in advance and the upper layer is comprised of polyimide. Due to that, it is possible to carry out stable ejection due to enhanced wettability.

Further, in the case that polyimide is provided in the lower layer and polyparaxylylene is provided in the upper layer, in particular, when polyimide is provided by an electrodeposition method, in comparison with the reverse case, an electric voltage applied to an electrode can be suppressed and a uniform good quality layer can be easily formed and also easily manufactured. Further, since polyparaxylylene has tolerance against acid and alkali and also has tolerance against almost any of organic solvents, a range of ink compositions to which polyparaxylylene can be adaptable is very broad and polyparaxylylene can be used for ink-jet for various usages.

Further, when the polyimide layer and the organic layer are multilayered, in the same manner, the thickness of the multilayer, that is, the distance between the opposite surface of the surface, on which the polyparaxylylene layer of the polyimide layer is provided, and the extreme surfaces, on which the polyimide layer of the polyparaxylylene layer is provided, is preferably in the range of 1 to 50 $\mu$m.

In the present invention, polyimide layer 9 can be allowed to dissolve in a solvent soluble polyamide, and when required, can be provided on driving electrode 7, employing an electrodeposition method in a solution prepared by adding an acid or base and a nonsolvent, or alternatively in a suspension (refer to W. M. Alvino et al., J. Appl. Polym. Sci., 27, 341 (1982) and 28, 267 (1983).

Such solvents include, for example, sulfoxides, formamides, acetoamides, pyrrolidones, phenols, lactones.

Preferred are dimethylsulfoxide, N,N'-dimethylformamide, N,N'-dimethylacetoamide, N-methyl-2-pyrrolidinone, N-cyclohexyl-2-pyrrolidone, N-vinyl-2-pyrrolidone, tetramethylurea, and sulfolane.

The electrodeposition method of the present invention is described below. An electrodeposition composition is prepared by neutralizing a polyimide composition for electrodeposition having a carboxylic acid group, which is dissolved in a polar solvent, with a basic compound, and then by adding a poor solvent for polyimide as well as water to the neutralized composition. Known as poor solvents for polyimide are various types of solvents. By specifically employing benzyl alcohol, substituted benzyl alcohol, furfuryl alcohol, and the like, it is possible to obtain a polyimide electrodeposition layer having excellent smoothness as well as minuteness. Employed as neutralizers are N-dimethylethanol, triethylamine, triethanolamine; N-dimetylbenzylamine, and N-methylmorpholine. Of these, N-dimethylethanol as well as N-methylmorpholine is suitable.

The employed amount of neutralizers is in the range in which polyimide is dissolved in a water-polar solution or dispersed while retaining stability. Generally said amount is at least 30 mole percent of the theoretical neutralization amount. In the electrodeposition composition comprised of electrodeposition components, the solid portion concentration of polyamide is controlled to be between 5 and 30 percent by weight. Employed as the electrodeposition coating method may be those conventionally known without need for alteration. Namely, an electrically conductive material, which receives electrodeposition, is immersed in the polyimide electrodeposition composition at a temperature between 15 and 35° C., and an electrodeposition layer is formed on said electrically conductive electrodepositing material which receives electrodeposition under the electrical conditions of a voltage preferably between 20 and 400 V, and an electric current running time between 30 seconds and 10 minutes, but preferably between 1 and 15 minutes.

The electrodeposited polyimide layer of the present invention comprises a small amount of solvents. When said electrodeposited layer is washed with a low boiling point displacement solvent which is compatible with said solvents but does not dissolve said polyimide, the electrodeposited layer is readily fixed onto the driving electrode. As described above, when it is desirable that the polyimide layer is a layer substantially comprised of poyimide, which contains a small amount of solvents, it is possible to readily form said layer employing the electrodeposition method. Further, said polyimide layer may comprise materials other than a small amount of solvents. By employing such a layer, it is possible to control the layer so as to have the desired layer properties.

Usefully employed as such fixing solvents are alcohols such as methanol and ethanol, ketones such as acetone, methyl ketone, and the like, mixtures thereof, and mixtures of these with a suitable amount of water. Subsequently, washing and air-drying are carried out, and heat fixing is then carried out at a temperature of 60 to 200° C. from 30 minutes to 24 hours. If desired, heating may be carried out under vacuum. Washing may be carried out employing methanol, ethanol, dioxane, ethyl acetate, and mixtures thereof instead of water.

Solvent-soluble polyimides are described in the following publications: E. S. Moyer, D. K. Mohanty, C. A. Arnold, J. E. McGrath, "Synthesis and Characterization of Soluble Polyimide Homo- and Copolymers", Polymeric Materials, Science & Engineering Proceedings of ACS Division of Polymeric Materials, V60, pages 202 to 205, Spring 1989; M. E. Rodgers, C. A. Arnold, J. E. McGrath, "Soluble, Processable Polyimide Homopolymers and Copolymers", Polymer Reprints, ACS Division of Polymer Chemistry, V30∝1, page 296, 1989; Y. Oishi, M. Xie, M. Kakimoto, Yoshio, "Syntheses and Characterization of Soluble Aromatic Polyimides and Polyimides from 1,1-(bis(4-aminophenyl)-2,2-dipenylethylene", Polymeric Materials, Science & Engineering Proceedings of ACS Division of Polymeric Materials, V60, pages 757 to 761, Spring 1989; F. W. Harris, Y. Sakaguchi, "Soluble Aromatic Polyimides Derived from New Phenylated Diamines", Polymeric Materials, Science & Engineering Proceedings of ACS Division of Polymeric Materials, V60, pages 187 to 192, Spring 1989.

Polyimides of the present invention are synthesized employing tetracarboxylic dianhydrides and diamines. There is no particular limitation on said employed tetracarboxylic dianhydrides. Examples of useful acid dianhydrides in the practice of the present invention include pyromellitic dianhydride, 3,3',4,4'-biphenyltetracarboxylic dianhydride, 3,3',4,4'-benzophenonetetracarboxylic dianhydride, 3,3',4,4'-diphenylsulfonetertacaroxylic dianhydride, 3,3',4,4'-diphenylethertertacaroxylic dianhydride, 3,3',4,4'-diphenylmethanetertacaroxylic dianhydride, 2,3,3',4'-diphenyltertacaroxylic dianhydride, 2,3,3',4'-diphenylethertertacaroxylic dianhydride, 2,3,3',4'-benzophenonetertacaroxylic dianhydride, 2,3,6,7-naphthalenetertacaroxylic dianhydride, 1,4,5,7-naphthalenetertacaroxylic dianhydride, 1,2,5,6-naphthalenetertacaroxylic dianhydride, 2,2-bis(3,4-dicarboxylphenyl)propanic dianhydride, 2,2-bis(3,4-dicarboxylphenyl)hexafluoropropanic dianhydride, 4,4'-bis(3,4-dicarboxypenyl)diphenylsulfidic dianhydride, 1,3-diphenylhexafluoropropane-3,3,4,4-tetracarboxylic dianhydride, 1,4,5,6-naphthalenetertacaroxylic dianhydride, 2,2',3,3'-diphenyltertacaroxylic dianhydride, 3,4,9,10-perylene tetracarboxylic dianhydride, bis(3,4-dicarboxyphenyl)ethernic dianhydride, naphthalene-1,2,4,5-tertacaroxylic dianhydride, naphthalene-1,4,5,8-tertacaroxylic dianhydride, decahydronaphthalene-1,4,5,8-tertacaroxylic dianhydride, 4,8-dimethyl-1,2,3,5,6-hexahydronaphthalene-1,2,5,6-tertacaroxylic dianhydride, 2,6-dichloronaphthalene-1,4,5,8-tertacaroxylic dianhydride, 2,7-dichloronaphthalene-1,4,5,8-tertacaroxylic dianhydride, 2,3,6,7-tetrachloronaphthalene-1,4,5,8-tertacaroxylic dianhydride, phenantholene-1,8,9,10-tertacaroxylic dianhydride, cyclopentane-1,2,3,4-tertacaroxylic dianhydride, pyrrolidine-2,3,4,5-tertacaroxylic dianhydride, pyrazine-2,3,5,6-tertacaroxylic dianhydride, 2,2-bis(2,3-dicarboxyphenyl)propanic dianhydride, 1,1-bis(2,3-dicarboxyphenyl)ethanic dianhydride, 1,1-bis(3,4-dicarboxyphenyl)ethanic dianhydride-bis(2,3-dicarboxyphenyl)methanic dianhydride, and benzene-1,2,3,4-tetracarboxylic dianhydride, and derivatives as well as mixtures thereof.

In order to obtain solvent-soluble polyimides, there is no particular limitation on advantageous tetracarboxylic dianhydrides. However, listed may be bipenyltetracarboxylic dianhydride, benzophenonetetracarboxylic dianhydride, 4,4'-[2,2,2-trifluoro-1-(trifluoromethyl)ethylidene]bis(1,2-benzenedicaroxylic dianhydride, bis(carboxyphenyl)ether dianhydride, and bicyclo(2,2,2)-octo-7-ene-2,3,5,6-tetracaroxylic dianhydride. These may be employed individually or in combination as a polyimide composition.

Further, there is no particular limitation on said employed diamines. Examples of preferred diamines in the practice of the present invention include 4,4'-diaminodiphenyl ether, 3,3'-dimethyl-4,4,diaminobiphenyl, 3,3'-dimethoxy4,4'-diaminobiphenyl, 4,4'-diaminoparaterphenyl, 4,4'-bis(4-aminophnoxy)-biphenyl, 4,4'-diaminophenylsulfone, 3,3'-diaminodiphenylsulfone, bis[4-(4-aminophnoxy)phenyl] sulfone, bis[4-(3-aminophenoxy)phenyl]sulfone, bis[2-(aminophenoxy)phenyl]sulfone, 1,4-bis(4-aminophnoxy) benzene, 2,2'-dichloro-4,4'-diamino-5',5'-dimethoxybiphenyl, 2,2'-5,5'-tetrachlorobenzidine, 9,10-bis (4-aminophenyl)anthracene, o-tolidinesulfone, 1,3-bis(4-aminophenoxy)benzene, 1,3-bis(3-aminophenoxy)benzene, 1,4-bis(4-aminophenyl)benzene, bis[4-(aminophenoxy) phenyl]ether, 4,4'-diaminodiphenylmethane, bis(3-ethyl-4-aminophenyl)methane, bis(3-methyl-4-aminophenyl) methane, bis(3-chloro-4-aminophenyl)methane, 2,2',5,5'-tetrachloro-4,4'-diaminobiphenyl, 4,4'-diaminodiphenylsulfide, 3,3'-diaminodipheny ether, 3,4'-diaminodiphenyl ether, 4,4'-diaminodiphenylmethane, 4,4'-diaminooctafluorobiphenyl, metaphenylenediamine, 2,2-bis [4-aminophenoxy]phenyl]propane, 2,2-bis[4-(4-amonophenoxy)phenyl]hexafluoropropane, 2,2-bis(4-aminiphenyl)propane, 2,2-bis(4-aminophenyl) hexafluoropropane, 2,2-bis(3-hydroxy-4-aminophenyl) propane, 2,2-bis(3-hydroxy-4-aminophenyl) hexafluoropropane, 9,9-bis(4-amoniphenyl)-10-hydroantharacene, orthotolydinesulfone, 3,3',4,4'-biphenyltetramine, 3,3',4,4'-tetraaminodiphenyl ether, diaminoanthraquinone, 1,5-diaminoanthraquione, bis[4-(4-amonophenoxy)phenyl]sulfone, bis[4-(3-aminophenoxy) phenylsulfone, bis[4-(2-aminophenoxy)phenyl]sulfone, 3,3'-dichloro-4,4'-diaminobiphenyl, 3,3'-dihyroxy-4,4'-diamino biphenyl, 4,4'-diaminobiphenyl, 9,9-bis(4-aminophenyl)fluorene, 4,4'-dimethyl-3,3'-diaminodiphenyl sulfone, 3,4'-Bisaniline-A, Bisaniline-M, Bisaniline P, methylene-bis-2,6-xylidine, 4-diamino cumene, 2,5-dichloro-p-phnylenediamine, 2,6-dichloro-p-phenylenediamine, 2,5-dimethyl-p-phenylenediamine, 2-chloro-p-phenylenediamine, 4-chloro-m-phenylenediamine, 5-chloro-2-methyl-p-phenylenediamine, Acetoguanamine, 2,3,5,6-tetramethyl-p-phenylenediamine, 2,4,6-trimethyl-m-phenylenediamine, bis-3-aminopropyl-tetramethyldisiloxane, 2,7-diaminofluorene, 2,5-diaminopyridine, p-phenylenediamine, 1,2-bis(anilino) ethane, diaminobenzanilide, diaminobenzoate, 1,5-diaminonaphthalene, diaminotoluene, diaminobenzotrifluoride, diaminoanthraquinone, 1,3-bis (anilino)hexafluoropropane, 1,4-bis(anilino) octafluorobutane, 1,5-bis(anilino)decafluoropentane, 1,7-bis (anilino)tetradecafluoroheptane, 2,2-bis[4-(3-aminophenoxy)phenyl]hexafluoropropane, 2,2-bis[4-(2-aminophenoxy)phenyl]hexafluoropropane, 2,2-bis[4-(4-aminophenoxy)-3,5-ditrifluoromethylphenyl] hexafluoropropane, p-bis(4-amino-2-trifluoromethylphenoxy)benzene, 4,4'-bis(4-amino-2-trifluoromethylphenoxy)biphenyl, 4,4'-bis(4-amino-3-trifluoromethylphenoxy)biphenyl, 4,4'-bis(4-amino-2-trifluoromethylphenoxydiphenylsulfone, 4,4'-bis(3-amino-5-trifluoromethylphenoxy)diphenylsulfone, 2,2-bis[4-(4-amino-3-trifluoromethylphenoxy)phenyl] hexafluoropropane, 3,3',5,5'-tetramethylbenzidine, 3,3'-dimethoxybenzidine, o-tolidine, m-tolidine, 2,2'5,5',6,6'-hexadluorotolidine, and 4,4'-diamino quaterphenyl, as well as mixtures thereof.

Specifically advantageous diamines are not particularly limited. However, it is possible to cite the following:

1,4-benzenediamne
6-methyl-1,3-benzeneamine
4,4'-diamino-3,3'-dimethyl-1,1'-biphenyl
4,4'-amino-3,3'-dimethoxy-1,1'-bipenyl
4,4'-methylenebis(benzeneamine)
4,4'-oxybis(benzeneamine)
3,4'-oxybisbenzeneamine)
4,4'-thiobis(benzeneamine)
4,4'-sulfonyl(benzeneamine)-3,3'-sulfonyl(benzeneamine)
1-trifluoromethyl-2,2,2-trifluoroethyldyne-4,4'-bis (benzeneamine)
2,2'-bis[4-(4-aminophenoxy)phenyl]sulfone
bis(4-(3-aminophenoxy)phenyl)sulfone
1,3-bis[1-(4-aminophenyl)-1-methylethylidene]benzene
1,4-bis(3-aminophenoxy)benzene
1,3-bis(3-aminopehoxy)benzene
9,9-bis(4-aminophenyl)fluorene diaminosiloxane, and the like. These may be employed individually or in combination as the polyimide composition.

Further, polyimides may be block polyimides comprised of three or more components which are synthesized via polyimide oligomers. When suitable components are employed in said block polyimides, it is possible to simultaneously satisfy desired properties such as solvent solubility, electrophoretic properties, heat resistance, hydrophilicity, mechanical adaptability, and the like.

In order to produce polyimides in which mechanical strength, heat resistance, thermal degradation resistance, and processability are improved, an oligomer of sulfonamide is produced, and subsequently, block polyimide resins may be obtained by adding acid dianhydrides. Further, the oligomer of amido acid is synthesized by adding 1.5 to 2.0 moles of acid dianhydride to diamine in a polar solvent and allowing the resulting mixture to react with each other. When the resulting products are allowed to react with isocyanate in an equivalent amount, polyimidoamide carboxylic acid is obtained, while generating carbon dioxide gas. Further, in order to obtain a polyimide layer, which closely adheres to a substrate, it is possible to produce siloxane-imide block copolymers as described below. Acid dianhydride is added to diaminosiloxane copolymer, and thereby siloxane-amido acid block copolymer is prepared. Thereafter, diamine in an equivalent amount is added to the resulting products to form polyamido acid. Subsequently, a thermal or chemical process is carried out to produce the desired siloxane-imide block polymer. Still further, acid dianhydride in an excessively large or excessively small amount is added to aromatic diamine. By allowing these to react with each other, polyamido acid prepolymer is produced. Subsequently, diamine in an amount, which covers shortage, is added to obtain polyamido acid copolymer. Then, by applying a chemical or heating process, it is possible to produce polyimide copolymer. In this method, the reaction passes through polyamido acid as an intermediate. As a result, it is impossible to minimize an exchange reaction of said produced polyamido acid. Thus, the resulting polymer is accompanied with randomness.

Electrodepositing polyimides are obtained employing acid dianhydrides which are substituted with a substituent capable of providing cations or anions to the component through electrolytic dissociation or diacids. Employed as substituents, which provide cations are, for example, three-functional block isocyanates and prepolymers of isocyanates, which are mixed with polymers having a hydroxyl group or an amine group as the functional group and subsequently are co-dispersed into a water/an acid solution.

There are primary, secondary, and tertiary-amines, quaternary ammonium salts, quaternary ammonium hydroxide, quaternary phosphates, tertiary sulfates, quaternary ammoniumcarboxylic acid salts, and the like, which are water-soluble by the addition of acid. In order to obtain cation electrodepositing polyimides, such substituents may be introduced into the polyimide chain. More preferably, 2,6-diaminopyridine may be employed as one part of the diamine components.

A substituent, which provides anions, is a carboxyl group. In order to obtain anion electroplatable polyimides, such substituents may be introduced into the polyimide chain. The most preferred aromatic diamines employed in polyimide are required to be accompanied with aromatic diaminocarboxylic acids. Listed as aromatic diaminocarboxylic acids are 3,5-diaminobenzoic acid, 2,4-diaminophenyl acetic acid, 2,5-diaminoterephthalic acid, 3,5-diaminoparatoluic acid, 3,5-diamono-2-naphthalenecaroxylic acid, 1,4-diamino-2-naphthalenecaroboxylic acid, and the like. However, the 3,5-diaminobenzoic acid is most preferably employed.

Acids, which are added to an electrodeposition composition comprising cationic electrodepositing polyimide having a substituent capable of providing cations, are commonly organic acids, particularly such as acetic acid and lactic acid. Bases, which are added to an electrodeposition composition comprising anionic electrodepositing polyimide having a substituent capable of providing anions, commonly are amines such as triethylamine, diethylamine, and various type of alkali, for example, potassium hydroxide.

As a method to obtain a uniform thick polyimide layer on a metal surface, well known is an electrodeposition method which employs polyamido acids. When employing said method, in order to convert the electrodeposited layer comprised of polyamido acid to polyimide, it is essential to carry out, for example, heating at a temperature of 180 to 350° C. thereafter. It is difficult to carry out such heating process without degrading the piezoelectric performance of a piezoelectric element having a finite Curie point. In the method of the present invention, after the formation of an electrodeposited layer, specifically, it is unnecessary to carry out heating. Thus it is possible to form a stable layer only by evaporating solvents and drying.

In order to enhance the effects of the present invention, the layer prepared on the electrode is subjected to electrodeposition, and after the layer formation, its surface is preferably subjected to oxidation treatment. Said oxidation treatment methods include the following:

(a) Surface oxidation employing oxidizing agents: Members are immersed in aqueous acid solution of potassium or sodium dichromate, and sodium or potassium permanganate. Members are placed in sodium perchlorate or halogen gas such as chlorine and the like, or immersed into an aqueous halogen gas solution.

(b) In air and oxygen gas, or in halogen gas, any of hot gas flow, flame, ultraviolet radiation, γ radiation, and the like is applied to members.

(c) Members are subjected to oxidation having-high activity such as corona, ozone, plasma, and the like. The thickness of the oxidized layer obtained on the surface by such oxidation treatments is at most several μm, and is generally in the range represented in the Angstrom units. Accordingly, the degradation of regional quality as the entire members is extremely small. On the contrary, due to said oxidation treatment, the affinity of the member to ink is markedly enhanced. Thus the adhesion of bubbles conveyed into the ink and formed in the ink to the members is minimized, and further, bubbles are conveyed to the exterior of the ink supplying system. Thus it is possible to minimize printing problems as well as ejection problems due to bubbles. Further, treatments other than said oxidation treatment may be carried out which enhance the affinity of ink to members. The oxidation treatment exhibits advantages of the ease of treatment as well as the uniformity of treatment effects to the layer surface. Particularly preferred is the plasma treatment cited in (c).

Next, examples of the present invention will be described below.

EXAMPLE 1

A water-receiving unit equipped with a stopcock was arranged in the lower part of a stirrer, a nitrogen gas feed pipe, and a cooling pipe. While running nitrogen gas, and further stirring, a reaction vessel was immersed in silicone oil, and heated to proceed with reaction. The temperature of the silicone oil represented the reaction temperature. Added to the reaction vessel were 64.44 g (0.2 mole) of 3,4,3',4'-benzophenonetetracarboxylic dianhydride, 42.72 g (0.1 mole) of bis-[4-(3-aminophenoxy)phenyl]sulfone, 3 g (0.03 mole) of valerolactone, 4.8 g (0.006 mole) of pyridine, 400 g of NMP (abbreviation of N-methylpyrrolidone), and 90 g of toluene. The resulting mixture was stirred for 30 minutes at room temperature and then heated. Reaction was carried out while stirring at 200 rpm at 180° C. for one hour. After the reaction, 30 ml of toluene-water distillated portion were removed. After cooling by air, 32.22 g (0.1 mole) of 3,4,3',4'-benzopenonetetracarboxylic dianhydride, 15.22 g (0.1 mole) of 3,5-diaminobenzoic acid, 11.01 g (0.1 mole) of 2,6-diaminopyridine, 222 g of NMP, and 45 g of toluene were added. The resulting mixture was stirred (at 200 rpm) at room temperature. Subsequently, the mixture was heated to 180° C. and stirred for 3 hours. Then 15 ml of a toluene-water distillated portion were removed. After that, while removing the distillated portion to the outside system, the mixture was heated to 180° C. and stirred for 3 hours and the reaction was completed, whereby 20 percent of polyimide varnish was obtained. The acid equivalent (a polymer amount of 1554 per COOH) was 36.

A water-based electrodepositing composition was prepared by mixing and stirring 100 g of the polyimide varnish, 100 g of 3SN (a mixed solution of NMP; tetrahydrothiophene-1, and 1-dioxde=1:3 by weight), 50 g of benzyl alcohol, 2.60 g (neutralization ratio of 200 mole percent) of methylmorpholine, and 1 g of water. The obtained water-based electrodeposition composition contained 7.6 percent of block polyimide (block polyimide obtained by block copolymerization), exhibited a pH of 7.2, and an electric conductivity of 89 μS/cm at 29.8° C., and was a transparent solution tinted at a dark reddish brown.

A PZT electrode was immersed in the electrodeposition composition obtained as described above, and a polyimide layer having an average thickness of 0.1 μm was formed on said electrode by applying 60 V between said electrode and its counter electrode, employing a DC power source (PDA300-1A: Kikusui Denshi Kogyo).

The resulting layer depends on the electrode area as well as the applied charge amount. Therefore, during the formation of the layer, the thickness was controlled by regulating the applied charge amount, employing a coulomb meter (HF-203D: Hokuto Denko). After the formation of the desired layer, said layer was immersed for 5 minutes in a fixing composition, and subsequently dried at 80° C. for 24 hours under $10^{-3}$ torr, employing a vacuum dryer. Thereafter, a head was fabricated into a final form, and then the polyimide layer surface as well as the polymer surface employed in the ink flow channel was treated employing a plasma etching apparatus (DEM451: Nihon Aneruba) so as to obtain sufficient wettability. Thereafter, a completion test was carried out for evaluation. Specifically, the defective percent at the initial stage and the ratio of stable operation head after durability test ($10^{10}$ ejections) was evaluated. Under each condition, 1,000 heads were prepared and evaluated.

EXAMPLE 2

The polyimide layer having an average layer thickness of 0.1 μm of Example 1 was replaced with a polyimide layer having a layer thickness of 1.0 μm, and the resulting layer was subjected to the same completion test as Example 1, and was evaluated.

EXAMPLE 3

The polyimide layer, having an average layer thickness of 0.1 μm of Example 1, was replaced with a polyimide layer having a layer thickness of 10 μm, and the resulting layer was subjected to the same completion test as Example 1, and was evaluated.

EXAMPLE 4

Block polyimide was produced as follows: 32.22 g (0.1 mole) of 3,4,3',4'-benzophenonetetracarboxylic dianhydride, 21.63 g (0.05 mole) of bis-[4-(3-aminophenoxy)phenyl]sulfone, 1.5 g (0.015 mole) of valerolactone, 2.4 g (0.03 mole) of pyridine, 200 g of NMP, and 30 g of toluene were stirred (at 200 rpm) at room temperature, and then heated. The resulting mixture was stirred at 180° C. for one hour. Then 15 ml of the toluene-water distillated portion were removed. After cooling by air flow, 6.11 g (0.05 mole) of 3,4,3',4'-benzopenonetetracarboxylic dianhydride, 15.216 g (0.1 mole) of 3,4-diaminobenzoic acid, 199 g of NMP, and 30 g of toluene were added. After the resulting mixture was stirred at room temperature for 30 minutes, the mixture was heated at 180° C. for one hour and then 15 ml of a toluene-water distillated portion was removed. After that, while removing the distillated portion, the mixture was heated while stirring at 180° C. for 2 hours and 30 minutes allowing the reaction to be completed. Thus polyimide having a concentration of 20 percent in the NMP composition was obtained.

A PZT electrode was immersed in the electrodeposition composition obtained as described above, and a polyimide layer, having an average thickness of 0.1 μm, was formed on said electrode by applying 60 V between the said electrode and its counter electrode, employing a DC power source (PDA300-1A: Kikusui Denshi Kogyo). Then the layer surface as well as the polymer surface employed in the ink channel was treated in the same manner as Example 1, employing a plasma etching apparatus (DEM451: Nihon Aneruba). Thereafter, the resulting layer was subjected to the completion test in the same manner as Example 1, and was evaluated.

EXAMPLE 5

3,4,3',4'-benzophenonetetracarboxylic dianhydride (48.33 g (0.15 mole)), 7.608 g (0.05 mole) of 3,5-diaminobenzoic acid, 5.507 (0.05 mole) of 2,6-diamonopyrimidine, 21.63 g (0.05 mole) of bis-[4-(3-aminophenoxy)phenyl]sulfone, 1.5 g (0.015 mole) of valerolactone, 2.4 g (0.03 mole) of pyridine, 311 g of NMP, and 50 g of toluene were mixed and stirred under a nitrogen flow for one hour. Subsequently, the resulting mixture was heated and 15 g of toluene-water distillated portion were removed at 180° C. for one hour. After that, while removing the distillated portion, the mixture was heated while stirring at 180° C. for 2 hours allowing the reaction to be completed. Thus 20 percent varnish was obtained. The acid equivalent (a polymer amount of 1554 per COOH) was 36.

A PZT electrode was immersed in the electrodeposition composition obtained as described above, and a polyimide layer, having an average thickness of 0.1 μm, was formed on said electrode by applying 60 V between the said electrode and its counter electrode, employing a DC power source (PDA300-1A: Kikusui Denshi Kogyo). Thereafter, the resulting layer was subjected to the completion test in the same manner as Example 1, and was evaluated.

EXAMPLE 6

A 1 μm thick polyimide was electrodeposited onto a PZT electrode, employing the electrodeposition composition of Example 1. Thereafter, a Palylene N layer, having an average thickness of 5 μm, was formed employing a Palylene layer forming apparatus (PDS-2010: Nihon Palylene). Then, a head was fabricated into final form. Thereafter, the Palylene N surface as well as the polymer surface employed in the ink channel was treated employing a plasma etching apparatus (DEM451: Nihon Aneruba) to secure sufficient wettability. The resulting head was subjected to completion test in the same manner as Example 1, and was evaluated.

EXAMPLE 7

Employing the electrodeposition composition of Example 1, a Palylene N layer, having an average thickness of 5 μm, was formed with the use of Palylene layer forming apparatus (PDS-2010 of Nihon Palylene). Thereafter, a PZT electrode was immersed in the electrodeposition composition, and a flat polyimide layer was electrodeposited by applying 60 V between said PZT electrode and its counter electrode employing a DC power source. Due to the presence of previously formed Palylene layer, it was impossible to form a layer having uniform thickness. However-, the layer was formed so that the average thickens in the area adjacent to the pinhole of the Palylene layer, having less thickness, was 1 μm. The resulting layer was immersed in a fixing composition for 5 minutes. Thereafter, drying was carried out at 80° C. for 24 hours under $10^{-3}$ torr using a vacuum dryer. Then, a head was completely structured. Thereafter, the polyimide surface as well as the polymer surface employed in the ink channel was treated employing a plasma etching apparatus (DEM451: Nihon Aneruba) to secure sufficient wettability. Then, a head was fabricated into final form. The resulting head was subjected to completion test in the same manner as Example 1, and was evaluated.

EXAMPLE 8

The poyimide layer, having an average thickness of 0.1 μm of Example 1, was replaced with a polyimide layer having a thickness of 20 μm. Then, said completion test was carried out for evaluation in the same manner as Example 1.

EXAMPLE 9

The poyimide layer, having an average thickness of 0.1 μm of Example 1, was replaced with a polyimide layer having a thickness of 50 μm. Then, said completion test was carried out for evaluation in the same manner as in Example 1.

Comparative Example 1

Inorganic Protective Layer

An $SiO_2$ layer, having an average thickness of 5 μm, was formed on a PZT electrode employing a plasma CVD apparatus (PD-240: Samuko International Co. Ltd.). Subsequently, a head was fabricated into final form. Then the completion test was carried out in the same manner as Example 1 as well as evaluation.

Comparative Example 2

A Palylene N layer, having an average thickness of 5 μm, was formed on a PZT electrode employing a Palylene layer forming apparatus (PDS-2010: Nihon Palylene). Thereafter, a head was fabricated into final form. Then the Palylene N layer surface as well as the polymer surface employed in the ink channel was treated to secure sufficient wettability, employing a plasma etching apparatus (DEM451: Nihon Aneruba). Thereafter, the completion test was carried out for evaluation in the same manner as Example 1.

Table 1 shows the evaluation results of Examples 1 through 9 and Comparative Examples 1 and 2.

TABLE 1

| | Initial Defective Ratio | Defective Ratio after Forced Degradation | Defective Occurrence |
|---|---|---|---|
| Example 1 | 0% | 1.0% | |
| Example 2 | 0% | 0.7% | |
| Example 3 | 0% | 0.3% | |
| Example 4 | 0% | 0.9% | |
| Example 5 | 0% | 1.0% | |
| Example 6 | 0.2% | 0% | |
| Example 7 | 0% | 0% | |
| Example 8 | 0.5% | 0.2% | |
| Example 9 | 0.8% | 0% | |
| Comparative Example 1 | 87.2% | 100% | Generation of a nozzle incapable of carrying out ejection due to problems of the protective layer |
| Comparative Example 2 | 2% | 15% | Generation of a nozzle incapable of carrying out ejection due to problems of the protective layer |

As can be seen from Table 1, heads, in which the electrodeposited polyimide layer was employed as the protective layer, exhibited an initial defective ratio of 0 percent as well as a defective ratio after the forced degradation of no more than 1 percent overall. Specifically, the head comprising the multilayer consisting of the lower Palylene layer and the upper polyimide layer resulted in no defects.

What is claimed is:

1. A method for manufacturing an ink-jet head wherein said ink-jet head comprises an ink chamber having a piezoelectric element and an electrode on the piezoelectric element, said method comprising the steps of:

forming a first layer containing a polyimide by an electrodeposition method on said electrode.

2. The method of claim 1 further comprising the step of:

changing a surface energy of the first layer.

3. The method of claim 2 wherein the changing step is a step of increasing the surface energy of the first layer.

4. The method of claim 2 wherein the changing step is an oxidizing process.

5. The method of claim 2 wherein the changing step is a plasma process.

6. The method of claim 1 further comprising the step of:

forming a second layer on the electrode.

7. The method of claim 6 wherein the second layer is an organic layer.

8. The method of claim 7 wherein the second layer contains a polyparaxlylene.

9. The method of claim 6 wherein the second layer is formed on the first layer.

10. The method of clam 1 wherein the polyimide is made from 3,5-diaminibenzoic acid.

* * * * *